US006497065B1

(12) United States Patent
Huston

(10) Patent No.: US 6,497,065 B1
(45) Date of Patent: Dec. 24, 2002

(54) FIREARM BARREL HAVING PROTECTIVE SLEEVE

(75) Inventor: Robert B. Huston, McMinnville, OR (US)

(73) Assignee: Michaels of Oregon Co., Oregon City, OR (US)

( * ) Notice: Subject to any disclaimer, the term of this patent is extended or adjusted under 35 U.S.C. 154(b) by 0 days.

(21) Appl. No.: 09/312,205

(22) Filed: May 14, 1999

(51) Int. Cl.[7] ..... F41A 21/04; F41A 21/18
(52) U.S. Cl. ..... 42/76.02; 42/78; 89/16
(58) Field of Search ..... 42/76.02, 78; 89/14.05, 89/16

(56) References Cited

U.S. PATENT DOCUMENTS

| | | | | | |
|---|---|---|---|---|---|
| 2,767,464 | A | * | 10/1956 | Nack et al. | 29/194 |
| 3,118,243 | A | * | 1/1964 | Manshel | 42/76.02 |
| 3,742,640 | A | * | 7/1973 | Thomsen | 42/76.02 |
| 4,685,236 | A | * | 8/1987 | May | 42/76.02 |
| 4,769,938 | A | * | 9/1988 | Chesnut et al. | 42/76.02 |
| 4,841,836 | A | * | 6/1989 | Bundy | 89/15 |
| 5,581,928 | A | * | 12/1996 | Krumm et al. | 42/76.02 |
| 5,600,912 | A | * | 2/1997 | Smith | 42/76.01 |
| 5,692,334 | A | * | 12/1997 | Christensen | 42/76.02 |
| 6,189,431 | B1 | * | 2/2001 | Danner et al. | 89/16 |

FOREIGN PATENT DOCUMENTS

| | | | | |
|---|---|---|---|---|
| GB | 369782 | * | 3/1932 | 89/14.1 |
| GB | 679570 | * | 9/1952 | 42/76.02 |
| JP | 406101993 | * | 4/1994 | 42/76.01 |

* cited by examiner

*Primary Examiner*—Stephen M. Johnson
(74) *Attorney, Agent, or Firm*—Stoel Rives LLP

(57) ABSTRACT

A firearm barrel has components made of different materials. The barrel includes an elongate metal insert member. A rigid sleeve surrounds the insert member along a majority of the length of the insert member. A casing is located around at least a portion of the sleeve.

1 Claim, 1 Drawing Sheet

FIREARM BARREL HAVING PROTECTIVE SLEEVE

BACKGROUND OF THE INVENTION

The present invention relates to a firearm barrel having components made of different materials, in which a protective sleeve is disposed between a rifled metal insert and an exterior light weight material.

Firearm manufacturers have desired to manufacture light weight firearm barrels for some time. Such light weight barrels are desired, especially in connection with firearms that will be used for target shooting, especially when the firearm will be held for long periods of time. In addition, light weight barrels are desired for firearms that will be carried into the field for hunting.

One approach to manufacture a light weight firearm barrel has involved the use of a rifled liner, or metal insert, wrapped in a protective material. Rifled liners are long metal inserts which are used to refurbish traditional metal rifle barrels in which the interior of the barrel has been damaged or worn over time. The rifled liners are thin and very susceptible to bending. One method to make a light weight firearm barrel has been to hand wrap the rifled liner with fiberglass such as ACCULIGHT. The fiberglass is then ground to produce a smooth surfaced firearm barrel. This method, while producing a light weight firearm barrel, is very labor intensive and, accordingly, very expensive. Additionally, because the rifled liner is very susceptible to bending, great care must be taken in connection with wrapping the fiberglass around the rifled liner so as to maintain the alignment and, hence, shooting accuracy of the firearm barrel.

Yet another method that has been used to create light weight firearm barrels involves injection molding plastic material around a rifled liner. Such a process is shown in Chestnut, et al., U.S. Pat. No. 4,769,938. In this firearm barrel, the barrel includes a casing of plastic material that is located about the majority of the length of the rifled liner and extends throughout the length of the firearm barrel. In forming the plastic casing, the rifled liner (or metal insert) is supported in injection molding equipment that permits the injection molding of plastic to a desired diameter around portions of the rifled liner and other barrel components. The problem with injection molding plastic material around a rifled liner is that the heat and pressure used in connection with the injection molding process warps the rifled liner. Firearm barrels produced in this fashion therefore tend to exhibit poor shooting accuracy.

Accordingly, what is therefore desired is a light weight firearm barrel which is easily and inexpensively made and which exhibits good shooting accuracy.

SUMMARY OF THE INVENTION

"The present invention overcomes the aforesaid drawbacks of the prior art by providing a firearm barrel having components made of different materials. The firearm barrel comprises an elongate metal insert member. A rigid sleeve surrounds the metal insert member along a majority of the length of the metal insert member. A casing is located around portions of the sleeve along a majority of the length of the metal insert member. In one aspect of the invention, the metal insert member and sleeve are adhered to one another. In another aspect of the invention, the firearm barrel includes a breech portion and muzzle portion located at opposite ends of the firearm barrel, with the casing being located between the breech portion and the muzzle portion."

The various aspects of the present invention have one of more of the following advantages. The use of the sleeve surrounding the metal insert member protects the metal insert member during manufacture of the firearm barrel. Thus, where the firearm barrel is manufactured using an injection molding process, the sleeve protects against deformation of the metal insert member caused by the heat and pressure of the injection molding process. The sleeve thus results in a firearm barrel with enhanced shooting accuracy. In addition, the firearm barrel is simple and easy to manufacture.

The foregoing and other features and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
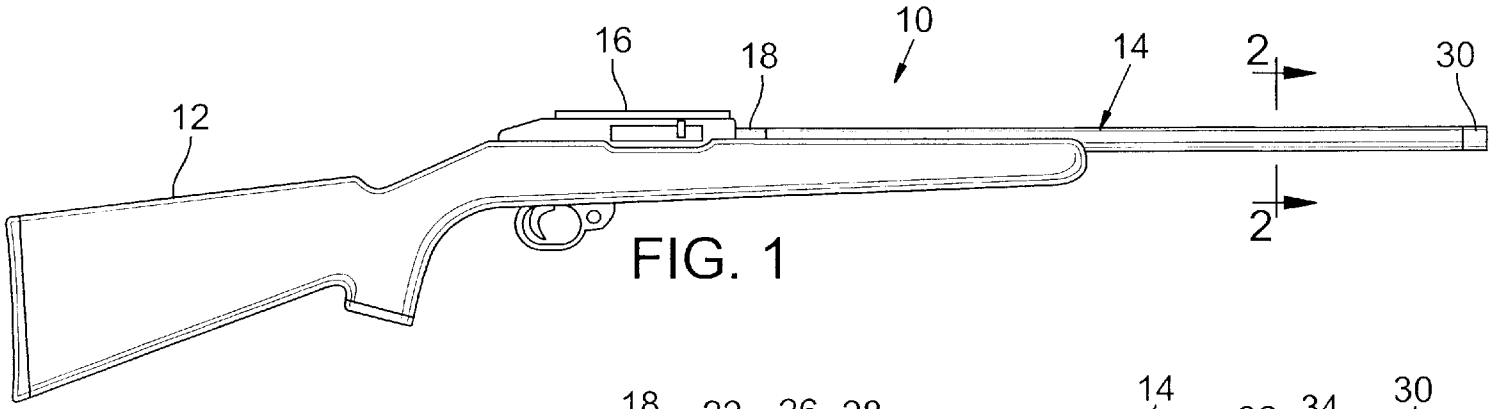
FIG. 1 shows a side view of a firearm having an exemplary firearm barrel of the present invention.
Figure 3:
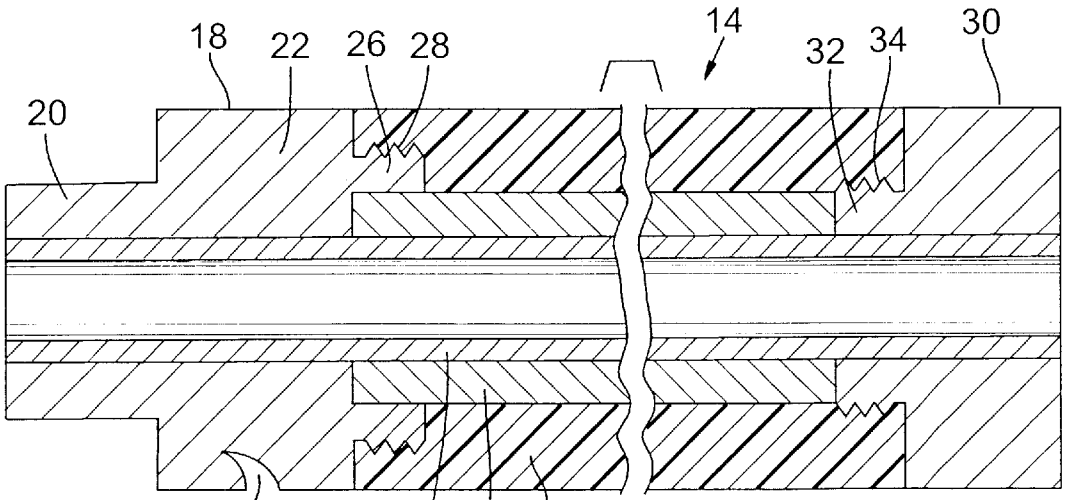
FIG. 3 shows a fragmentary cross section taken along the length of the exemplary firearm barrel of FIG. 1.
Figure 2:
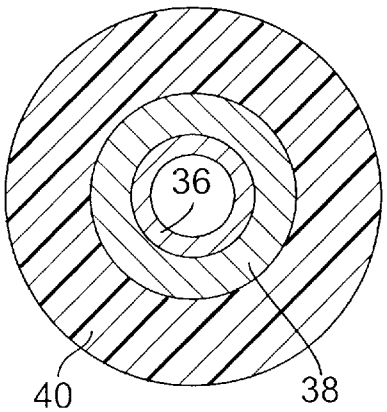
FIG. 2 shows a cross section of the firearm barrel of FIG. 1 along the lines 2—2.

"With reference to the figures, wherein like numerals refer to like elements, FIGS. 1–3 show a firearm 10 having a stock 12 and barrel 14. The barrel 14 is connected to a receiver 16. While the drawings show a rifle barrel used in connection with a rifle, the firearm barrel of the present invention may be used with any firearm having a rifled bore, such as a rifle or handgun."

"The firearm barrel 14 includes a breech portion 18 having a reduced diameter section 20 which is adapted to be received by a sleeve of a rifle chamber (not shown). The section 20 has a cut-out portion or notch (not shown) for receiving an extractor slot held in the rifle chamber. The breech portion 18 also has a center section 22 having a barrel notch 24 formed in a portion thereof."

"The firearm barrel 14 also has a muzzle portion 30. Like the breech portion 18, the muzzle portion 30 has a stem 32 formed with serrations, or the like, 34, which extend outwardly from the surface of the stem 32 as shown in FIG. 3. Preferably, the muzzle portion 30 is made of a stiff, heat-resistant material, preferably stainless steel."

"The barrel 14 also includes an elongated metal insert member 36 which is received by bores formed in the breech portion 18 and the muzzle portion 30 as shown in FIG. 3. The metal insert member 36 preferably is substantially greater in length than the breech portion 18 and extends, preferably, for the entire length of the barrel 14. The metal insert member 36 preferably has a relatively thin wall so as to reduce the weight of the firearm barrel 14. The metal insert member is preferably rifled, and is most preferably a rifled liner."

"Surrounding the metal insert member 36 is a sleeve 38 as shown in FIGS. 2 and 3. The sleeve 38 surrounds the insert member 36 along at least a majority of the length of the insert member 36. The sleeve 38 is rigid, and, more preferably, is a heat-resistant material that can withstand the heat and pressure generated during an injection molding process. Preferably, the sleeve 38 is formed of a material such as aluminum, steel, carbon fiber or a strong polymeric material. The sleeve 38 is secured to the insert member 36 to prevent the insert member 36 from being blown out of the barrel 14 when shooting, and to enhance the shooting accuracy of the barrel 14 by eliminating any play between loose components. The sleeve 38 is preferably secured to the insert member 36 as follows. The inside bore of the sleeve 38 is reamed to have an inside diameter that is slightly larger, by about 0.003 inch, than the outside diameter of the insert member 36. The interior of the bore of the sleeve 38 is brushed with an adhesive, such as a 3M Plexus®MA300 adhesive. The insert member 36 is then inserted into the sleeve 38. Similarly, the insert member 36 and sleeve 38 are adhered to the breech portion 18 and the muzzle portion 30. Alternatively, the insert member 36 may be connected to the breech portion 18 and muzzle portion 30 by press fitting, by the use of threads, or other conventional mechanical fastening methods. The breech portion 18 has an interior bore within the stem 26 capable of receiving the sleeve 38, so that the sleeve 38 is inserted within a portion of the breech portion 18 and adhered to the breech portion 18. This has the advantage of providing additional reinforcement to the insert member 36 by eliminating a shear point between the breech portion 18 and sleeve 38. Similarly, the muzzle portion may also have an interior bore within the stem 32 to accommodate the sleeve 38."

"After the insert member 36, sleeve 38, breech portion 18 and muzzle portion 30 have been secured together, a casing 40 of a moldable material is injection molded around at least part of the sleeve 38, preferably a majority of the sleeve 38, and, more preferably, surrounding the entire sleeve 38, as shown in FIGS. 2 and 3. The casing 40 is made of a light weight material that is less dense than traditional metals used in the manufacture of firearm barrels. The casing may be a thermoplastic copolymer. Preferably, the casing 40 is made of a blend of polymers and carbon fibers which results in a low shrink rate. In one preferred embodiment, the casing 40 is comprised of a glass reinforced polymeric material sold by Modified Plastics under the trade name UT1018 Makroblend. The breech portion 18, insert member 36, sleeve 38 and muzzle portion 30 are supported in injection molding equipment that permits the injection molding of the casing 40 to a desired diameter around at least portions of the sleeve 38. The optional serrations 28 and 34 assist in maintaining a tight connection between the casing 40, the breech portion 18 and the muzzle portion 30."

Because the sleeve 38 is rigid and preferably heat resistant, the sleeve 38 protects the insert member 36 from being deformed or warped during the injection molding process. Thus, the present invention provides a significant advantage over injection molding processes wherein the casing 40 is molded directly onto the insert member 36. The resulting firearm barrel with the sleeve 38 has the advantage of lighter weight, by the use of the less dense material for the casing 40, but also has greater shooting accuracy than the prior art barrels formed by injection molding the casing 40 directly onto the insert member 36.

"While the firearm barrel 14 of the present invention has been shown with a muzzle portion 30, the muzzle portion 30 may be omitted. Instead, the sleeve 38 may be extended to the end of the insert member 36. The casing 40 may be injection molded to the end of the sleeve 38 and insert member 36. The casing 40 may then require additional finishing, such as by turning on a lathe or grinding to achieve the desired exterior."

In another aspect of the invention, the casing 40 may be made of a light weight material that may be applied in a manner other than by injection molding. For example, the casing 40 could be made of a fiberglass material that is wrapped around the sleeve 38 by hand. Because the sleeve 38 is rigid, it maintains the alignment of the insert member 36 during application of the casing 40. Thus, the sleeve 38 decreases the degree of care needed during application of the casing 40 around the insert member 36 to prevent misalignment of the insert member 36. Accordingly, the use of the sleeve 38 results in a firearm barrel 14 having enhanced accuracy but which is less expensive to produce.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A firearm barrel having components made of different materials, comprising:

(a) an elongate metal insert member;

(b) a rigid metal sleeve surrounding said insert member along a majority of the length of said insert member;

(c) a rigid casing formed from a polumeric moldable material suitable for injection molding located around at least a portion of said sleeve, said casing being less dense than said sleeve; and (d) a muzzle portion made of a material that is different than the material of said casing, wherein said muzzle portion has a stem having outwardly extending serrations for securing said muzzle portion to said casing.

* * * * *

UNITED STATES PATENT AND TRADEMARK OFFICE

CERTIFICATE OF CORRECTION

PATENT NO. : 6,497,065 B1
DATED : December 24, 2002
INVENTOR(S) : Robert B. Huston It is certified that error appears in the above-identified patent and that said Letters Patent is hereby corrected as shown below:

Column 1-4,
Lines throughout, remove all quotation marks from the being and end of the amended paragraphs.

Column 4,
Line 41, “polumeric” should read -- polymeric --.

Signed and Sealed this

Eleventh Day of November, 2003

JAMES E. ROGAN
*Director of the United States Patent and Trademark Office*